US008201597B2

(12) United States Patent
Bouchard

(10) Patent No.: US 8,201,597 B2
(45) Date of Patent: Jun. 19, 2012

(54) WOOD LAGGING MACHINE

(76) Inventor: Paul Adelard Bouchard, Penticton (CA)

( * ) Notice: Subject to any disclaimer, the term of this patent is extended or adjusted under 35 U.S.C. 154(b) by 194 days.

(21) Appl. No.: 12/801,290

(22) Filed: Jun. 2, 2010

(65) Prior Publication Data

US 2010/0300582 A1 Dec. 2, 2010

Related U.S. Application Data

(60) Provisional application No. 61/213,361, filed on Jun. 2, 2009.

(51) Int. Cl.
*B27B 31/00* (2006.01)
*B27C 9/00* (2006.01)

(52) U.S. Cl. ..... 144/2.1; 144/4.2; 144/3.1; 144/245.2; 198/460.1

(58) Field of Classification Search ..... 144/2.1, 144/3.1, 242.1, 245.2, 250.17, 4.2; 198/459.1, 198/460.1
See application file for complete search history.

(56) References Cited

U.S. PATENT DOCUMENTS

| | | | | |
|---|---|---|---|---|
| 743,075 | A | 11/1903 | Hammond | |
| 1,781,424 | A * | 11/1930 | Anderson | 198/354 |
| 3,989,135 | A | 11/1976 | Pyykonen | |
| 4,405,276 | A | 9/1983 | Wiegand | |
| 4,869,360 | A | 9/1989 | Brown et al. | |
| 5,341,916 | A * | 8/1994 | Doane et al. | 198/460.1 |
| 5,921,376 | A | 7/1999 | Michell et al. | |
| 6,379,105 | B1 | 4/2002 | Aylsworth | |

* cited by examiner

*Primary Examiner* — Shelley Self
(74) *Attorney, Agent, or Firm* — Antony C. Edwards

(57) ABSTRACT

An apparatus for producing wood lagging blankets includes a board singulator, a board spacer, a wire strand feeder, and a fastener applicator. The board singulator includes an infeed and infeed queue, and a selectively actuable stop. The board spacer includes a spacing conveyor and may be selectively actuable according to instructions from a programmable controller, wherein the fastener applicator mounted aligned vertically over said at least one strand of wire to fasten by fasteners at least one strand of wire down onto the boards on said spacing conveyor to thereby form a lagging blanket of spaced apart boards spaced with substantially constant gapping between the boards, wherein said lagging blanket is tethered together as a stable matrix of laterally aligned, constantly spaced boards, and wherein the lagging blanket is sized to wrap completely around a desired circumference.

13 Claims, 13 Drawing Sheets

WOOD LAGGING MACHINE

CROSS REFERENCE TO RELATED APPLICATION

This application claims priority from U.S. Provisional Patent Application No. 61/213,361 filed Jun. 2, 2009 entitled Wood Lagging Machine.

FIELD OF THE INVENTION

This invention relates to the automated manufacture of wood lagging used for the protection of cylindrical objects such as a pipe.

BACKGROUND OF THE INVENTION

Wood lagging has been traditionally used for earth retention in applications such as retaining walls, drainage, mine shoring; for insulating layer between the boiler and jacket on steam locomotives, and for pipe casing. To date lagging has been manually assembled at the application site, or manufactured at an off site factory. In applications where long lengths of pipe need to be protected, the automated manufacture of lagging can reduce logistics and labour costs.

Automatic manufacture of lagging requires that lumber of some dimension is placed one board adjacent to another with a gap spacing between them such that when wrapped around a pipe of a given dimension that the lagging blanket ends meet with the same gap. Singulating lumber from a deck or pile and introducing the singulated piece into a lugged transfer is well documented in the following patents:

U.S. Pat. No. 5,921,376 titled "High speed revolving lug loader with retracting heel and hook", issued to Steven W. Michell et al on Jul. 13, 1999 describes a high speed revolving lug loader with retracting heel and hook in which presented boards are grasped by pinching the top and bottom surfaces between a heel and hook travelling on the circumference of a number of disks located along the length of the board and situated between the smooth and lugged conveyors. Again this does not allow for accurate and variable gapping between boards.

U.S. Pat. No. 4,869,360 titled "Lug loader", issued to Douglas J. Brown et al on Sep. 26$^{th}$, 1989 describes a lug loader in which a ducking stop allows one board at a time onto a speed up conveyor transferring the singulated board onto a lugged conveyor, and timed such that the singulated board is transferred on between lugs. Again this is not applicable in the present invention where accurate and variable gap control is required.

U.S. Pat. No. 3,989,135 titled "Apparatus for single feeding timber", issued to Niilo Pyykonen on Nov. 2, 1976 describes an apparatus for single feeding timber from a single layer mat by lifting a stopped board from one conveyor onto another using elevated flights on a transfer conveyor and placing the boards onto a lugged conveyor. This technique does not lend itself to variable gap control between boards.

Similarly the Applicant is aware of patents regarding the de-stacking of lumber as documented in the following patents:

U.S. Pat. No. 6,379,105 titled "Automatic Lumber Unloading and Feeding Apparatus", issued to Aylsworth on Apr. 30$^{th}$, 2002 describes an automatic lumber unloading and feeding apparatus that separates individual boards from a stacked unit using a pair of pushers to push the bottom tiers off of a supporting surface onto a conveyor below. The tier is then singulated by lifting all of the tier boards except for the first one simultaneous with a lifting gate that allows the singulated board to flow along the conveyor. This is more complicated than the present invention, lifting a mass of boards instead of one, and does not provide the means to accurately gap trailing to leading boards, which is fundamental to the present invention. It is also limited to a single width of board.

U.S. Pat. No. 743,075 title "Hoop or Band for Cylindrical Casings issued to Hammond on Nov. 3, 1903 teaches a hoop comprising a band with bent ends and a stave coupler to secure cylindrical casings made of lumber about pipe. This would typically require the lumber to be placed about the pipe, held by some secondary means and then secured with Hammond's invention. This approach is labor intensive and awkward to implement, requiring the casing to be built and retained in place around the pipe.

U.S. Pat. No. 4,405,276 titled "Apparatus for unstacking planks", issued to Karl-Wolfram Wiegand on Sep. 20, 1983 describes an apparatus for longitudinally pushing individual boards one at a time from the top tier of a stack using a traverse truck. The elevation of the stack is optimized using a scissor lift such that only the top tier clear a back stop opposing the direction of the truck travel, holding the lower tiers in place. As Wiegand does not disclose how the longitudinally singulated plank is landed or oriented in the downstream process it does not teach how to place planks adjacent to each other with a variably controlled gap for forming pipe casing or lagging.

Applicant is aware of automated stapling of straps to boards in the fabrication of bed frames, however in this instance the boards are placed in a fixed displacement lugged transfer by means of a lug loader, and straps are applied with automatic staplers.

Nowhere in the prior art is there taught a method for singulating lumber and precisely placing it adjacent to previously singulated board with a fixed but variable gap for any purpose, let alone forming the boards into a pipe casing, or lagging blanket.

SUMMARY OF THE INVENTION

The present invention serves to automatically produce wood lagging blankets for protecting buried pipe. The present invention permits different pipe circumferences to be lagged with different dimensioned wood by automatically adjusting the gap between boards and the number of boards used, without significantly reconfiguring or mechanically modifying the machine between lagging blanket sizes. The variable board gap required to achieve this is accomplished using a jumping gate and a servo-controlled conveyor with associated photo-eyes, encoders, and programmable controller.

BRIEF DESCRIPTION OF THE DRAWINGS

FIG. 9 (*a*) shows the initial state of the cycle: a loaded in-feed skid, raised jumping gate, and one board positioned on the servo conveyor.

FIG. 9 (*b*) shows the lowered jumping gate and two boards being positioned on the servo conveyor.

FIG. 9 (*c*) shows the lowered jumping gate and the two boards positioned correctly on the now stopped servo conveyor.

FIG. 9 (*d*) shows the two boards positioned correctly on the stopped servo conveyors, the jumping gate raised, and a new board moving into position from the in-feed skid.

FIG. 9 (*e*) shows again the initial state of the cycle, with two boards now positioned correctly on the servo conveyors.

FIG. 10 (*a*) shows the wood blankets positioned for wire cutting; the cut location being halfway between the end of the first blanket and the start of the second.

FIG. 10 (*b*) shows the knife actuating upwards and contacting the wire.

FIG. 10 (*c*) shows the knife cutting the wire against the anvil.

FIG. 10 (*d*) shows the wire cut into two pieces and the knife retracting.

DETAILED DESCRIPTION OF EMBODIMENTS OF THE INVENTION

Figure 1:
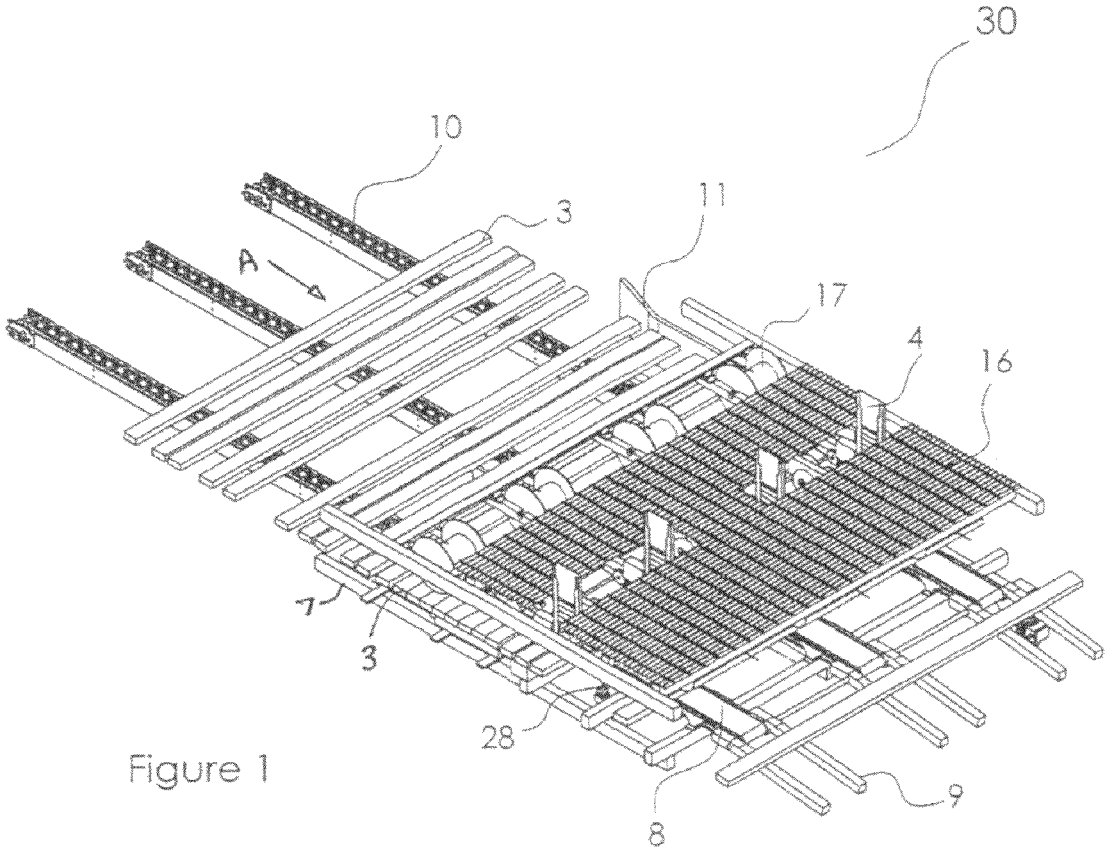
FIG. 1 is a front perspective view of the Wood Lagging Machine.
Figure 2:
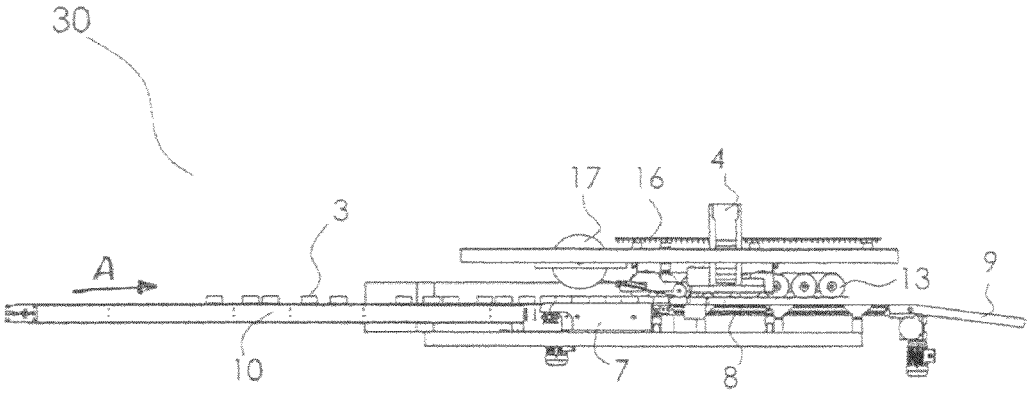
FIG. 2 is a side view of the Wood Lagging Machine.
Figure 3A:
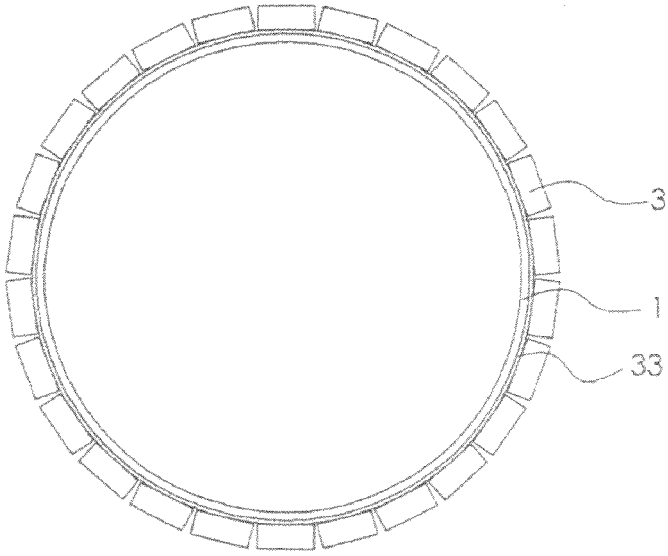
FIGS. 3 (*a*), (*b*) and (*c*) show different pipe diameters, board sizes and blanket gaps.
Figure 3B:
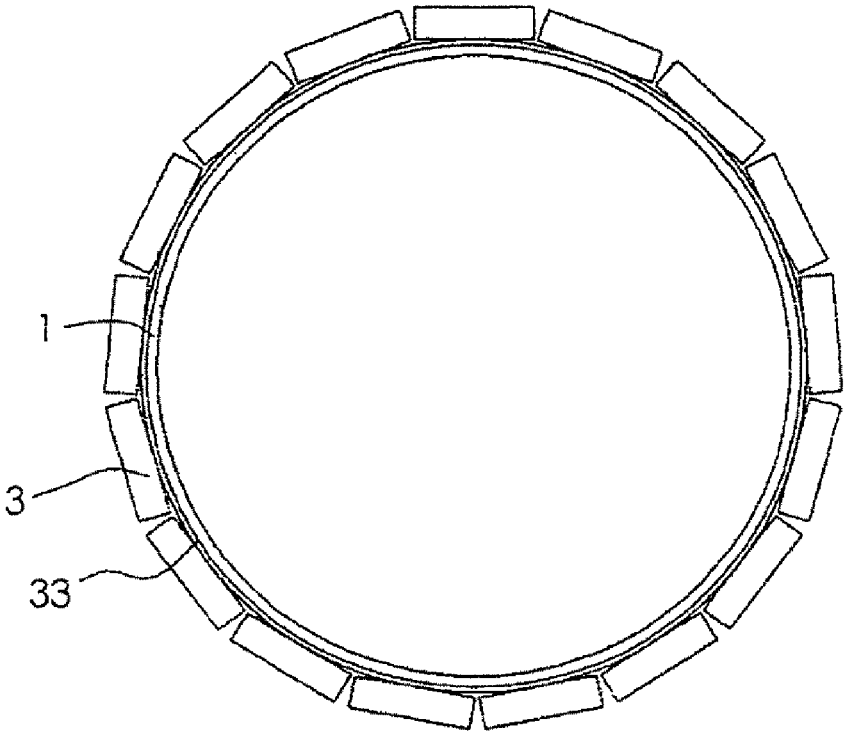
Figure 3C:
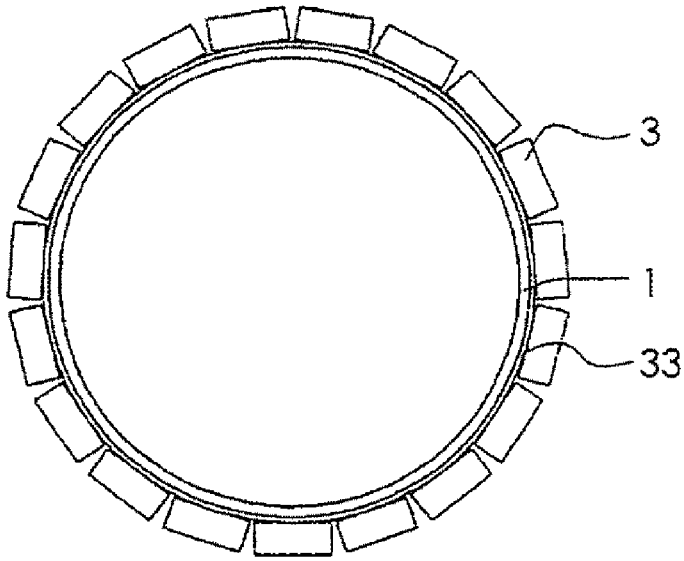
Figure 4A:
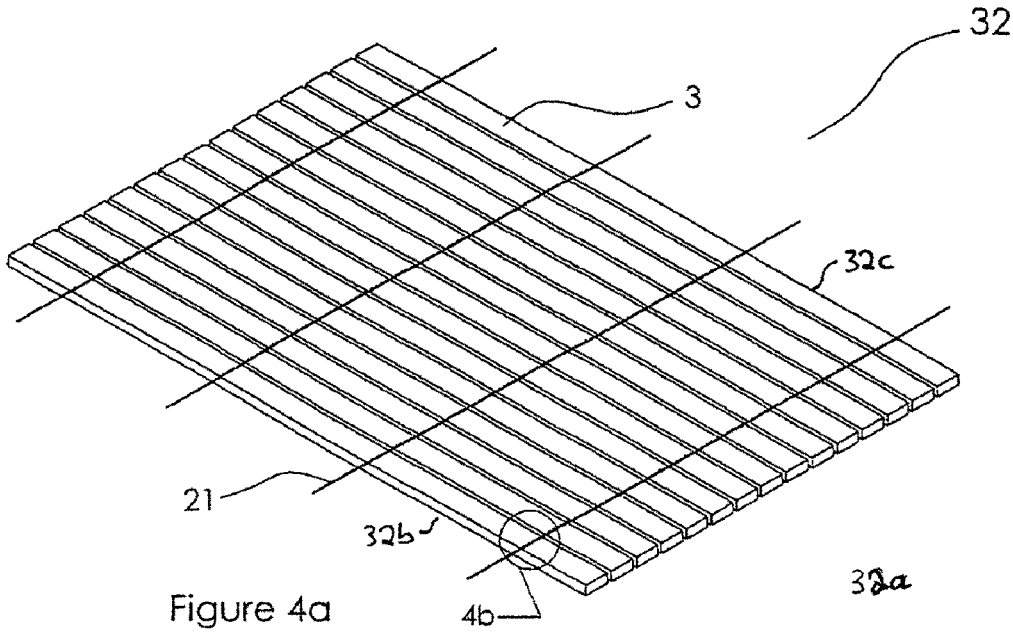
FIGS. 4 (*a*) and (*b*) show a blanket of boards with wire and staples.
Figure 4B:
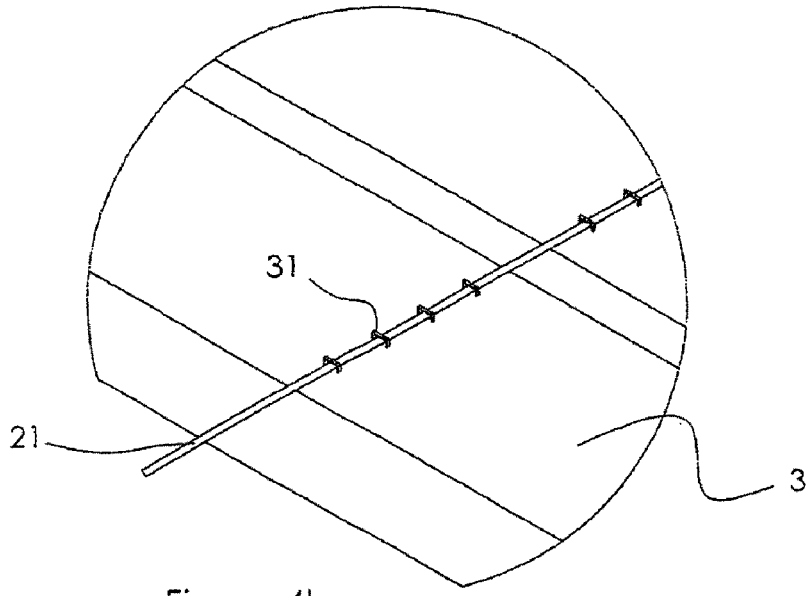
Figure 5A:
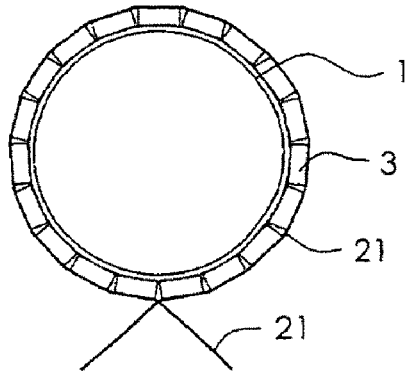
FIGS. 5 (*a*), (*b*) and (*c*) show a blanket of boards wrapped around a pipe, with the excess wire at the ends twisted together to temporarily hold the blanket around the pipe.
Figure 5B:
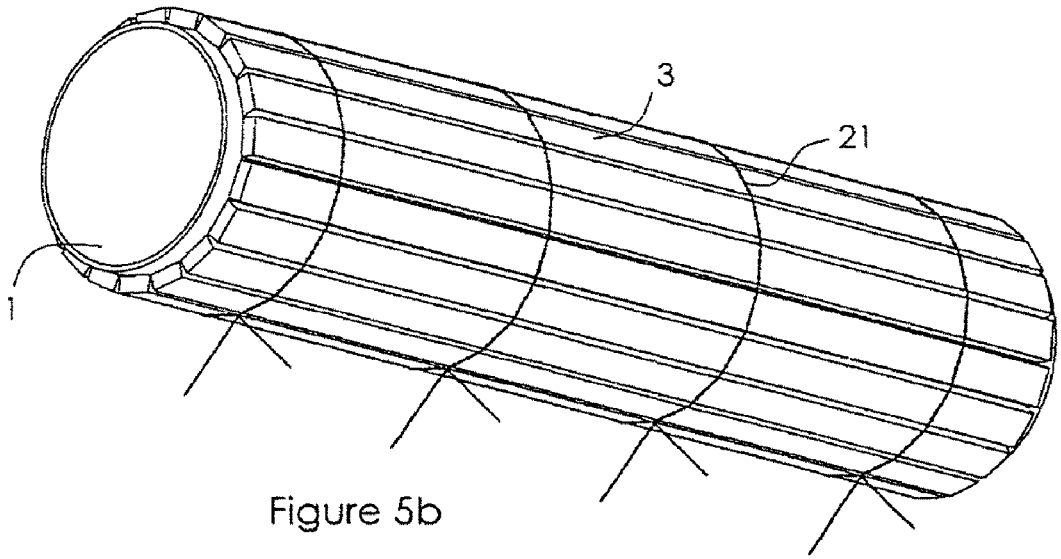
Figure 5C:
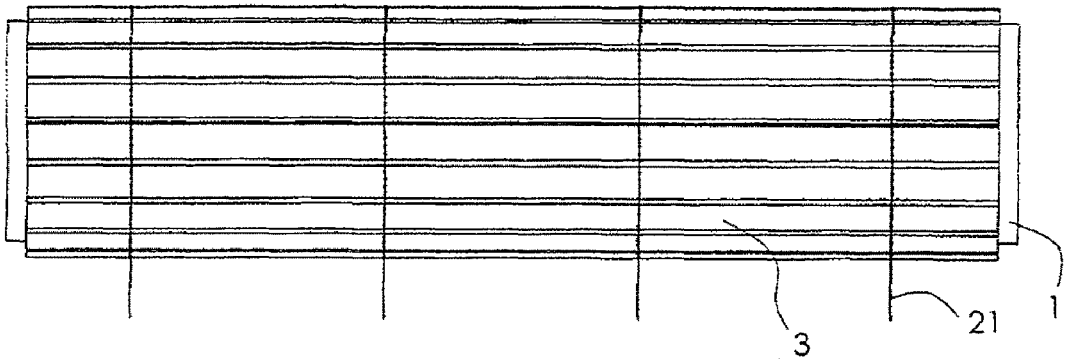
Figure 6A:
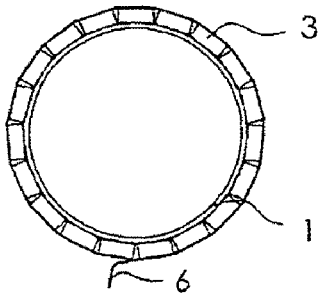
FIGS. 6 (*a*), (*b*) and (*c*) show a blanket of boards wrapped around a pipe, with steel banding used to permanently secure the blanket in place.
Figure 6B:
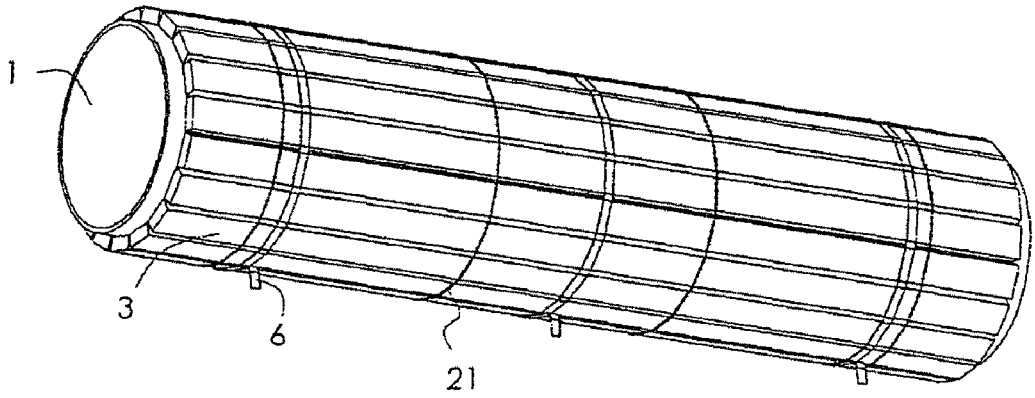
Figure 6C:
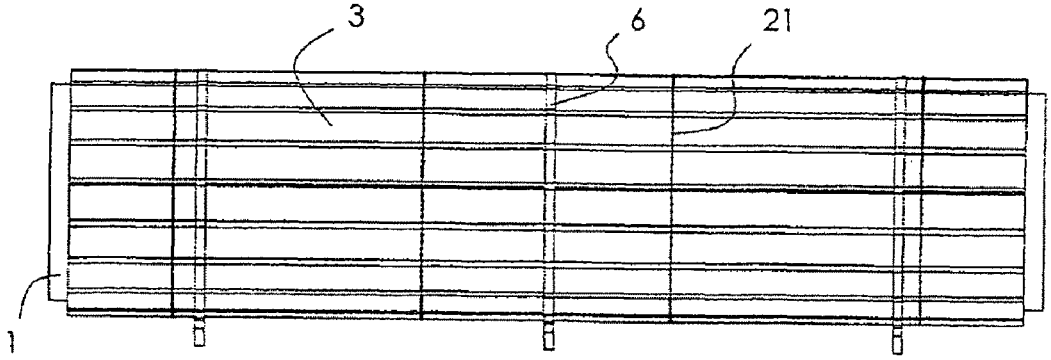
Figure 7:
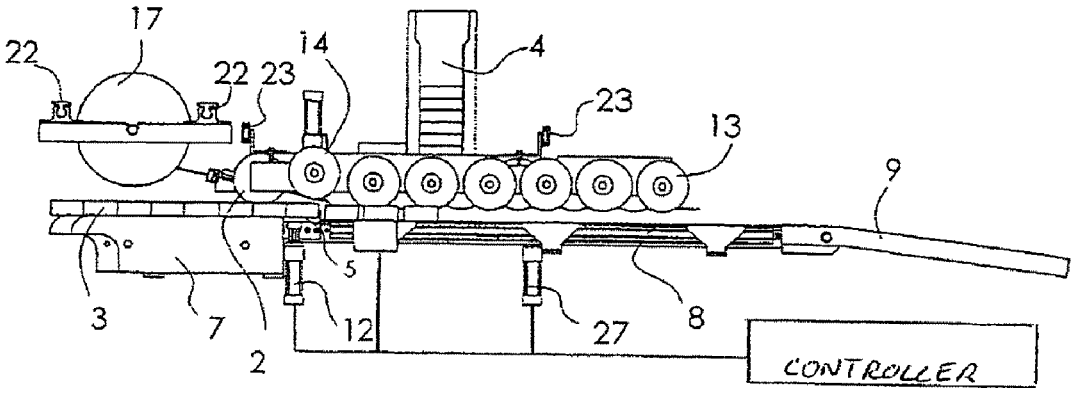
FIG. 7 shows a side view of the Wood Lagging Machine with the compliant guide wheels shown, and also illustrates diagrammatically a controller providing control parameters to the actuators and to the servo conveyor.
Figure 8:
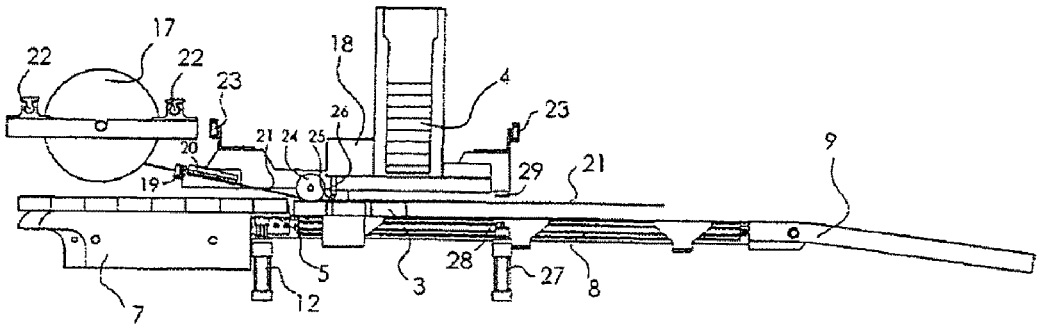
FIG. 8 shows a side view of the Wood Lagging Machine with the wire guides and stapling mechanisms visible.
Figure 9A:
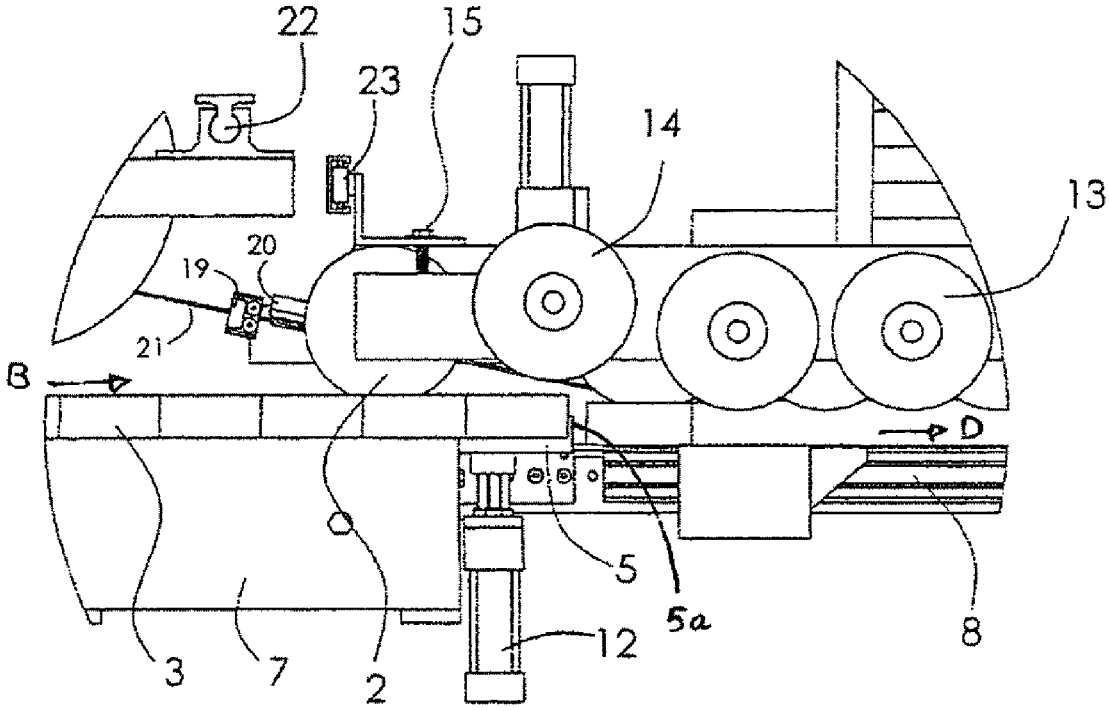
FIGS. 9 (*a*), (*b*), (*c*), (*d*), (*e*) show the Wood Lagging Machine in various stages of operation during the jumping gate and board positioning processes.
Figure 9B:
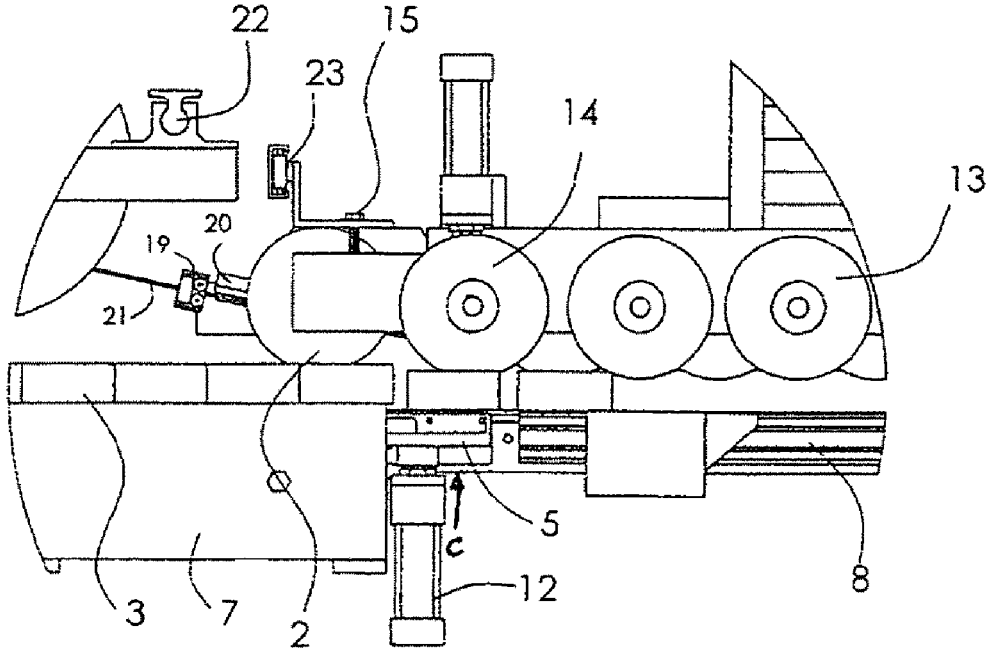
Figure 9C:
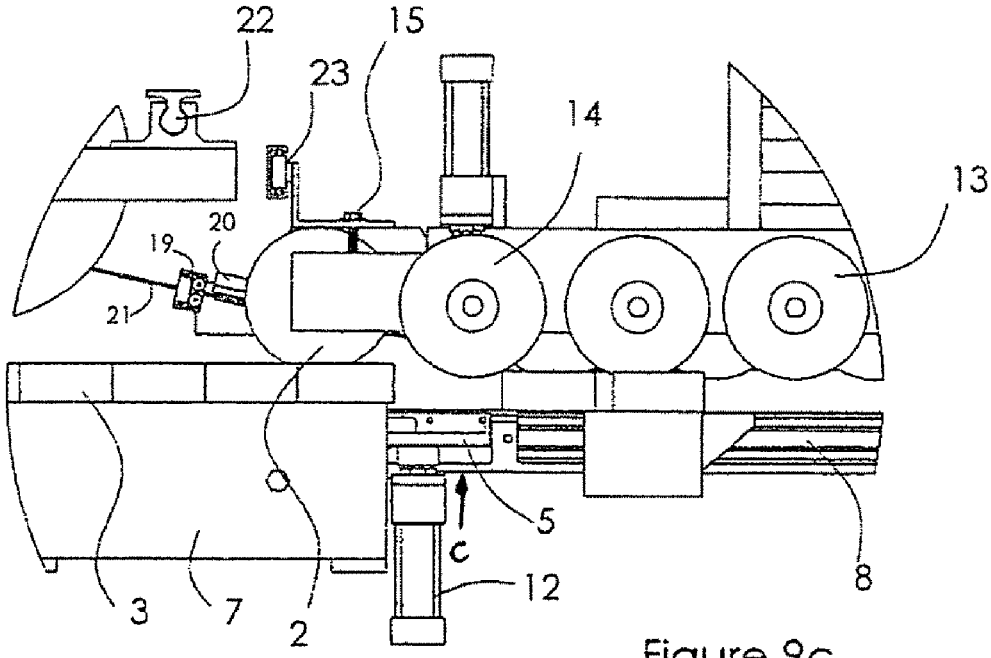
Figure 9D:
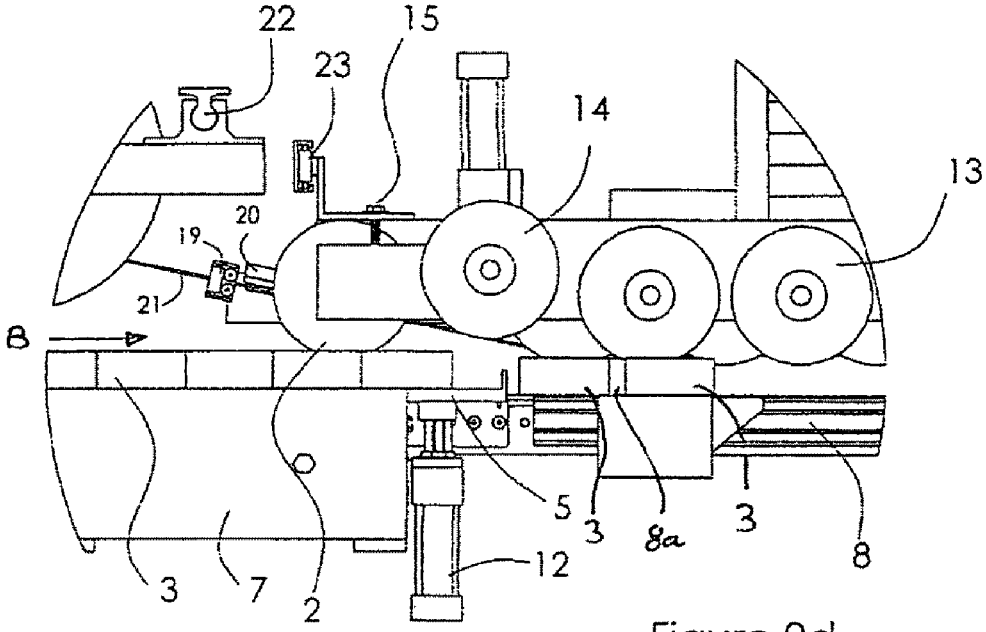
Figure 9E:
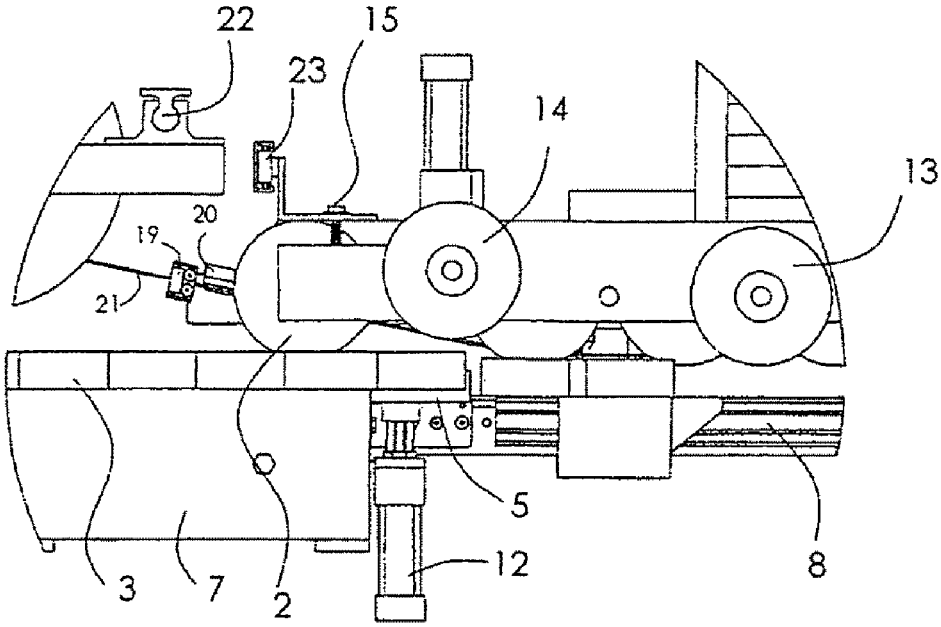
Figure 10A:
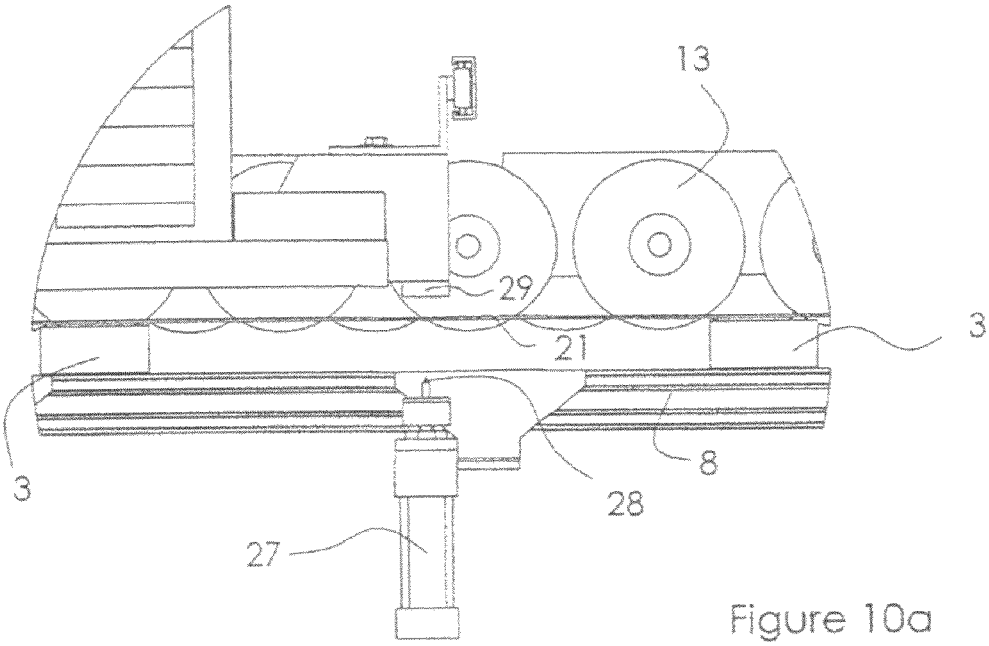
FIGS. 10 (*a*), (*b*), (*c*), (*d*) show the Wood Lagging Machine in various stages of operation during the wire cutting process, and in particular.
Figure 10B:
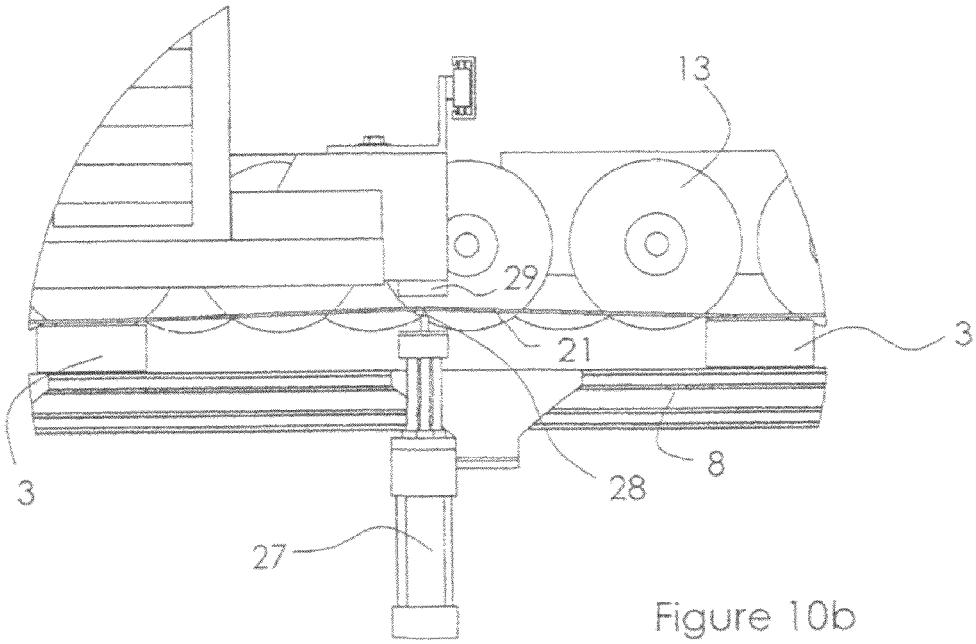
Figure 10C:
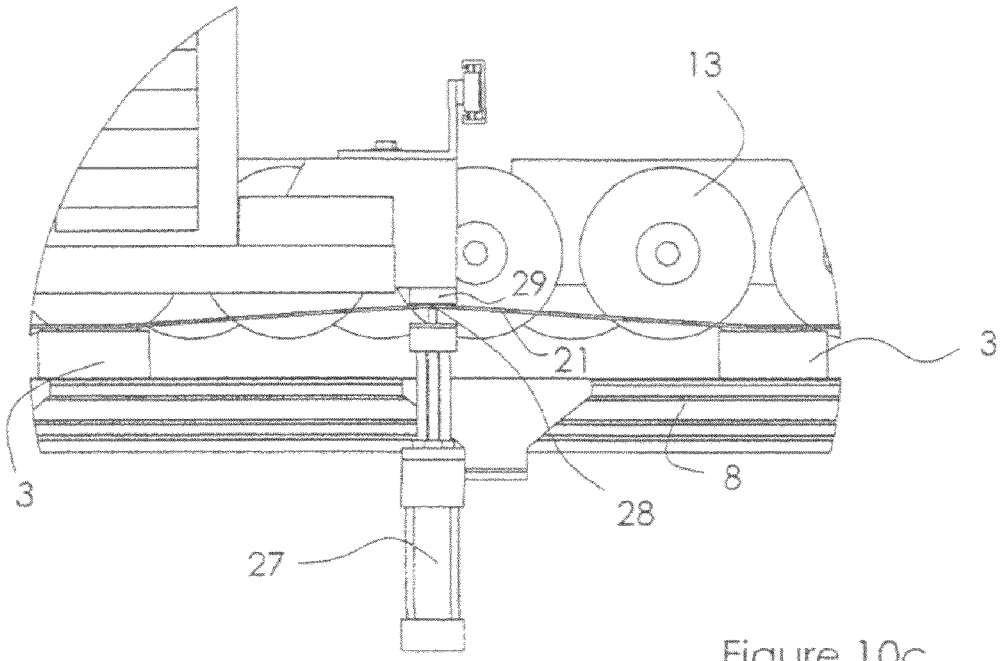
Figure 10D:
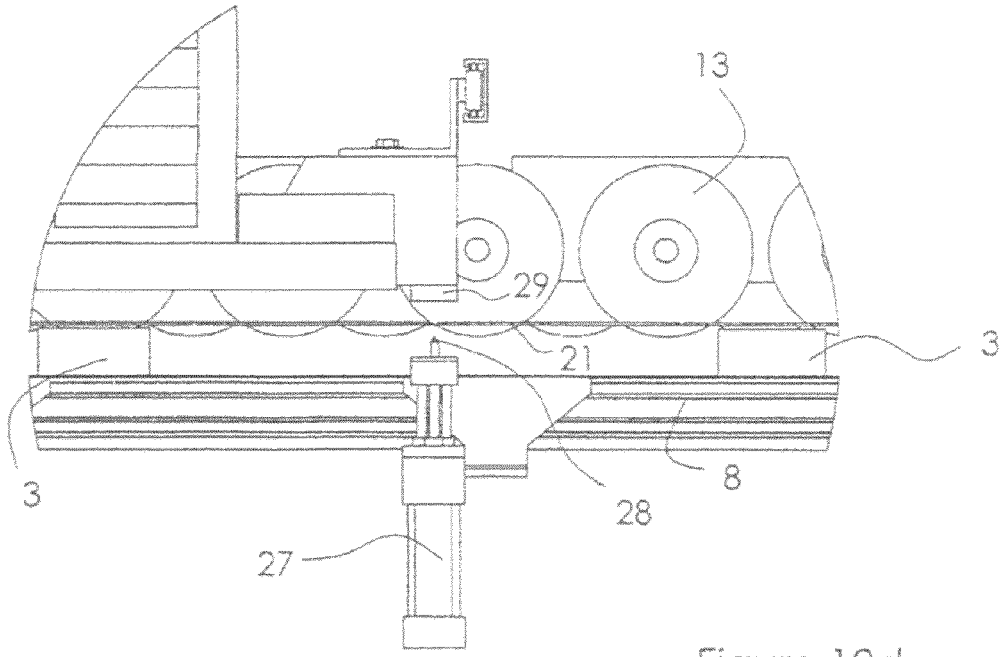

In the following description, read in conjunction with the drawing figures described above, like reference numerals denote corresponding parts and like reference characters denote corresponding directions in each view.

The present invention is a machine for producing wood lagging used to blanket pipes for protection.

Lagging 32 is typically made of boards 3 having 2 inch by 3 inch, 2 inch by 4 inch, or 2 inch by 6 inch nominal dimensions, and of lengths ranging from 6 to 12 feet, but is not limited to these dimensions. The pipe design may call for layers of protective material to be placed around the pipe prior to the lagging 32, which may alter the ultimate diameter of the pipe relative to the lagging 32. The lagging 32 is formed by placing boards 3 of a given dimension adjacent to each other spaced apart with a substantially constant gap between them such that the blanket of boards 32 for the pipe design in question, would measure the same width as the circumference called for by the pipe 1 design to be protected. Wire 21 is strung across the blanket of spaced boards 32 and stapled to each board 3 thereby stringing the boards together. Stapling is done at various locations along the length of the boards 3 to secure them sufficiently for the blanket 32 to remain intact when moved and installed around the pipe 1 (by for example initially temporarily twisting the wire ends together). Blanket 32 is then permanently secured in place with strapping 6. The number of wires 21 used may be varied depending on the desired lagging design.

The machine of the present invention has smooth-topped in-feed chains 10 onto which boards 3 are placed manually, semi-automatically, or automatically. The chain 10 advances in direction A towards a set of skids 7 onto which the boards 3 are pushed in direction B once there is a sufficient number of boards on the chain 10. The boards 3 may engage infeed guide 11, and straighten so as to be perpendicular to chains 10 as the boards advance along the skids 7 until the boards engage the first hold down wheel 2 and a jumping stop 5. The translation of in-feed chain 10 in direction A is turned on and off by a machine control system to optimize the back pressure in direction B on the boards on skids 7 to control board orientation while minimizing the possibility of overfeeding the boards during singulation by the jumping stop 5.

The jumping stop 5 is elevated in direction C by a linear actuator 12 (for example air, hydraulic, electric), and is dropped or lowered when a board 3 is ready to load onto the conveyor 8 for stapling. The stop 5 drops until its leading edge 5*a* is clear of the underside of the board 3 being placed, while an overhead hold-down wheel 14 actuates down onto the board. The boards downstream, that is, those previously positioned in the blanket are held down onto a servo positioned conveyor 8 by a series of additional non-actuating hold-down wheels 13. As the servo positioned conveyor 8 is advanced in direction D, wire 21 is fed along with the boards 3 under an automatic stapling mechanism 18 (such as a Senco™ pneumatic stapler), which applies typically two to four staples 31 to the board 3 to staple the wire to the boards at programmed intervals across the board face. The servo conveyor 8 continues to advance until the correct gap 8*a* is reached between the newly introduced board 3 and the jumping stop 5 face. The jumping stop 5 elevates in direction C along with the in-feed hold down wheel 14, allowing the next board 3 to advance in direction B onto the stop 5.

The cycle repeats with the next board 3 dropped onto the servo conveyor 8, advanced and stapled to the predetermined gap 8*a*. When the desired blanket width 32*a* has been completed for the pipe circumference the servo conveyor 8 advances the blanket 32 with the wire 21 such that a length of wire (for example 18 inches) without boards attached spans the downstream and incoming, that is, upstream boards. This length of wire is used to secure the two ends 32*b*, 32*c* of the blanket 32 when wrapped around the pipe 1. As the next blanket 32 is formed, and when the midpoint of the wire span (for example 9 inches) reaches the wire cutter, a linear actuator 27 raises and pushes a knife 28 against the wire 21 and an anvil 29 thereby severing the wire 21.

The completed blanket 32 continues to advance as the next blanket 32 is assembled until it is either manually, semi-automatically, or automatically removed from the out-feed 9 of the system, typically being stacked onto a pallet or dunnage for subsequent delivery to the pipe location for application.

The system of the present invention is controlled using a number of input variables such as pipe circumference and lumber size, which in turn dictate the gap size of gaps 8*a* between boards 3. The machine automatically spaces the boards 3 according to the gap size while stapling wires 21 to the board 3 at a number of locations along the length of the board 3 to form a blanket 32. The spacing of boards 3 is dynamic and adjustable without modification to the machine 30 other than the control parameters from a controller due to the collaborative operation of the servo conveyor 8 and the jumping stop 5 used to singulate the boards 3 being fed onto the servo conveyor 8 for stapling.

The stapling locations are adjustable when the machine is configure for a particular length of board being processed. Each automated stapler 18 has associated with it a staple magazine 4 (shown for example extending upwardly through catwalk 16 in FIG. 1), and a wire guide roll 24 and wire guide "eye" 25 for guiding the wire 21 directly under the stapler head 26, and in-feed wire guide 19, a limited slip powered wire straightener 20, and spool of wire 17 supported over the assembly deck. The limited slip powered wire straightener 20 both straightens and advances the wire 21 without overdriving the wire 21 towards the stapler 18. The tension of the already stapled blanket 32 advancing on the servo conveyor 8 provides the necessary additional tension on the wire 21 to pull it from the spool 17 with adequate tension and feed.

The present invention can be made compact enough to be transported to a pipeline installation site by means of a flatbed trailer or similar. In this way the wood lagging can be produced at the point of consumption thereby minimizing the cost of handling the lagging blankets between production and installation.

The present invention can also be scaled up for stationary production installations.

As will be apparent to those skilled in the art in the light of the foregoing disclosure, many alterations and modifications are possible in the practice of this invention without departing from the spirit or scope thereof.

What is claimed is:

1. An apparatus for producing wood lagging blankets comprising:

a board singulator including:

an infeed feeding boards to an infeed queue, said infeed queue for queuing a mat of boards in an alignment aligned traversly to a flow direction of said infeed and said infeed queue, a selectively actuable stop for selectively interrupting a translation of boards in said flow direction when said stop is actuated into a board engaging position and allowing said translation of boards in said flow direction when said stop is in a board disengaged position, a board spacer including:

a selectively actuable spacing conveyor for conveying the boards downstream in said flow direction from said stop without changing said alignment, and spacing the boards according to spacing instructions from a controller controlling actuation and translation speed of said spacing conveyor and actuation of said stop, a wire stand feeder feeding at least one strand of wire parallel to said flow direction and over said spacing conveyor so as to sandwich the boards on said spacing conveyor between said spacing conveyor and said at least one strand of wire, a fastener applicator mounted aligned vertically over said at least one strand of wire to fasten by fasteners at least one strand of wire down onto the boards on said spacing conveyor to thereby form a lagging blanket of spaced apart boards spaced with substantially constant gapping between the boards, wherein said lagging blanket is tethered together as a stable matrix of laterally aligned boards aligned laterally relative to said flow direction and wire strands aligned parallel to said flow direction.

2. The apparatus of claim 1 wherein said at least one strand of wire is a plurality of wire strands.

3. The apparatus of claim 2 wherein said queue includes rails to support the mat of boards thereon the boards are pushed over and long said rails by the infeed of the boards from said infeed.

4. The apparatus of claim 3 wherein said stop is at least one jump stop.

5. The apparatus of claim 4 further comprising hold-downs mounted over said spacing conveyor.

6. The apparatus of claim 5 wherein said hold-downs are non-driven and chosen from the group comprising rolls, rollers, wheels.

7. The apparatus of claims 6 wherein said fastener applicator includes a plurality of said fastener applicators aligned over, in cooperation with, said plurality of wire strands so that at least one of said fastener applicators is positioned directly over each wire strand of said plurality of wire strands.

8. The apparatus of claim 7 wherein each said fastener applicator is a staple gun.

9. The apparatus of claim 7 wherein said plurality of fastener applicators is at least four fastener applicators and wherein, correspondingly, said wire feeder includes at least four wire strand feeders aligned so as to pass corresponding said wire strands under said fastener applicators.

10. The apparatus of claim 9 wherein said wire strand feeders are mounted upstream of said fastener applicators and above said spacing conveyor so as to stream said wire strands downstream and under said fastener applicators.

11. The apparatus of claim 1 further comprising an outfeed adapted to draw, in said flow direction the assembled lagging blanket of the boards in said spacing conveyor.

12. The apparatus of claim 1 further comprising a selectively actuable wire cutter for cutting said at least one strand of wire upon controls from said controller.

13. The apparatus of claim 12 wherein said controller is adapted to coordinate at least actuation of said stop, actuation of said spacing conveyor, and actuation of said wire cutter so as to provide said constant gapping and so as to provide sufficient boards such that a required circumferential distance around a cylindrical object to be blanketed is provided by the spaced apart parallel array of boards on said spacing conveyor tethered and held to said constant gapping by a parallel spaced apart wire strand array of said at least one strand of wire, wherein said array of boards is overlaid by and is oriented perpendicularly to said wire strand array.

* * * * *